US006291550B1

(12) United States Patent
Chen et al.

(10) Patent No.: US 6,291,550 B1
(45) Date of Patent: Sep. 18, 2001

(54) SOLVENTLESS POLYURETHANE NO-BRAKE FOUNDRY BINDER

(75) Inventors: Chia-hung Chen; Ken K. Chang, both of Dublin, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 09/519,395

(22) Filed: Mar. 3, 2000

Related U.S. Application Data

(62) Division of application No. 09/226,940, filed on Jan. 8, 1999, now Pat. No. 6,063,833.

(51) Int. Cl.[7] ..... B22C 1/22

(52) U.S. Cl. ..... 523/142; 523/139; 523/143; 523/147; 164/47

(58) Field of Search ..... 523/139, 142, 523/143, 147; 164/47

(56) References Cited

U.S. PATENT DOCUMENTS 4,293,480 * 10/1981 Martin et al. ..... 523/143
4,540,768 * 9/1985 Speranza et al. ..... 528/79
4,946,876 * 8/1990 Carpenter et al. ..... 523/143
4,982,781 * 1/1991 Carpenter et al. ..... 164/526
5,132,339 * 7/1992 Carpenter et al. ..... 523/143
5,455,287 * 10/1995 Carpenter et al. ..... 523/143
5,688,857 * 11/1997 Chen et al. ..... 523/142
5,698,613 * 12/1997 Jhaveri ..... 523/139
5,859,091 * 1/1999 Chen et al. ..... 523/140

* cited by examiner

*Primary Examiner*—David W. Wu
*Assistant Examiner*—Ling-Siu Chol
(74) *Attorney, Agent, or Firm*—David L. Hedden

(57) ABSTRACT

This invention relates to a solventless polyurethane no-bake foundry binder system comprising, as individual components (a) a polyol component comprising a polyether polyol, glycol, and an aromatic polyester polyol, (b) an organic polyisocyanate component, and (c) a liquid tertiary amine catalyst component. Foundry mixes are prepared by mixing the binder system with a foundry aggregate by a no-bake process. The resulting foundry shapes are used to cast metal parts from ferrous and non-ferrous metals.

7 Claims, No Drawings

SOLVENTLESS POLYURETHANE NO-BRAKE FOUNDRY BINDER

This application is a division of application No. 09/226,940 filed on Jan. 8, 1999, now U.S. Pat. No. 6,063,833.

FIELD OF THE INVENTION

This invention relates to a solventless polyurethane no-bake foundry binder system comprising, as individual components (a) a polyol component comprising a polyether polyol, glycol, and an aromatic polyester polyol, (b) an organic polyisocyanate component, and (c) a liquid tertiary amine catalyst component. Foundry mixes are prepared by mixing the binder system with a foundry aggregate by a no-bake process. The resulting foundry shapes are used to cast metal parts from ferrous and non-ferrous metals.

BACKGROUND OF THE INVENTION

In the foundry industry, one of the processes used for making metal parts is sand casting. In sand casting, disposable foundry shapes (usually characterized as molds and cores) are made by shaping and curing a foundry mix which is a mixture of sand and an organic or inorganic binder.

One of the processes used in sand casting for making molds and cores is the no-bake process. In this process, a foundry aggregate, binder, and liquid curing catalyst are mixed and compacted to produce a cured mold and/or core. In the no-bake process, it is important to formulate a foundry mix which will provide sufficient worktime to allow shaping. Worktime is the time between when mixing begins and when the mixture can no longer be effectively shaped to fill a mold or core.

A binder commonly used in the no-bake process is a polyurethane binder derived by curing a polyurethane-forming binder with a liquid tertiary amine catalyst. Such polyurethane-forming binders used in the no-bake process, have proven satisfactory for casting such metals as iron or steel which are normally cast at temperatures exceeding about 1370° C. They are also useful in the casting of light-weight metals, such as aluminum, which have melting points of less than 815° C. The phenolic resin component typically contains small amounts of free formaldehyde and free phenol which are undesirable. Both the phenolic resin component and the polyisocyanate components generally contain a substantial amount of organic solvent which can be obnoxious to smell and smoke during the mixing and the pouroff stages in the workplace.

U.S. Pat. No. 5,689, 613 discloses polyurethane-forming foundry binders which use ester-based aromatic polyols as the polyol component of the binder. These binders are do not have any free formaldehyde or free phenol. However, they are too viscous to use without a solvent.

U.S. Pat. No. 5,688,857 discloses a polyurethane-forming cold-box binder which is solvent free and does not contain any free formaldehyde or free phenol. Although satisfactory for cold-box applications, this binder is not satisfactory for no-bake applications because early tensile strengths of cores and molds prepared with this binder were not sufficient. Consequently, there is an interest in improving the early tensile strengths for no-bake applications to allow the cores and molds to be more readily stripped from the pattern, and thus improve higher productivity.

SUMMARY OF THE INVENTION

This invention relates to a solventless polyurethane no-bake foundry binder system comprising:

(1) a polyol component comprising
  (a) a polyether polyol,
  (b) a glycol component, and
  (c) an aromatic polyester polyol component,
(2) an organic polyisocyanate component, and
(3) a liquid tertiary amine catalyst component.

Foundry mixes are prepared by mixing the binder with a foundry aggregate by a no-bake process. The resulting foundry shapes are used to cast metal parts from ferrous and non-ferrous metals. The binders do not contain free formaldehyde or free phenol, or solvents. The binder has low viscosity for easy pumping, low odor, and low smoke at pouroff. The early tensile strengths of cores and molds prepared with the binders are improved by the addition of the aromatic ester to the polyol component. The sand shakes out from the castings effectively and the surface finish of the casting is good.

BEST MODE AND OTHER MODES

The polyether polyols which are used in the polyurethane no-bake foundry binder are liquid polyether polyols generally having hydroxyl a number of from about 200 to about 1,000, more preferably from 300 to 800, and most preferably from 300 to 600 milligrams of KOH based upon one gram of polyether polyol. The viscosity of the polyether polyol is from 100 to 1,000 centipoise, preferably from 200 to 700 centipoise, most preferably 300 to 500 centipoise. The hydroxyl groups of the polyether polyols are preferably primary and/or secondary hydroxyl groups.

The polyether polyols are prepared by reacting an alkylene oxide with a polyhydric alcohol in the presence of an appropriate catalyst such as sodium methoxide according to methods well known in the art. Representative examples of alkylene oxide include ethylene oxide, propylene oxide, butylene oxide, amylene oxide, styrene oxide, or mixture thereof. The polyhydric alcohols typically used to prepare the polyether polyols generally have a functionality greater than 2.0, preferably from 2.5 to 5.0, most preferably from 2.5 to 4.5. Examples include ethylene glycol, diethylene glycol, propylene glycol, trimethylol propane, and glycerin.

The amount of the polyether polyol in the polyol component is generally from 10 to 50 weight percent, preferably from 20 to 40 weight percent, based upon the polyol component.

The glycols used in the polyol component are preferably monomeric glycols having an average functionality of 2 to 4, hydroxyl numbers from 500 to 2,000, more preferably from 700 to 1,200, and viscosities less than 200 centipoise at 25° C. preferably less than 100 centipoise at 25° C. Examples of such monomeric polyols include ethylene glycol, diethylene glycol, triethylene glycol, 1,3-propane diol, 1,4-butanediol, dipropylene glycol, tripropylene glycol, glycerin, tetraethylene glycol, and mixture thereof.

The amount of glycol the polyol component is generally from in the polyol component is generally from 10 to 50 weight percent, preferably from 20 to 40 weight percent, based upon the polyol component.

The aromatic polyester polyols used in the polyol component are liquid polyester polyols, or a blend of liquid aromatic polyester polyols, generally having a hydroxyl number from about 500 to 2,000, preferably from 700 to 1200, and most preferably from 250 to 600; a functionality equal to or greater than 2.0, preferably from 2 to 4; and a viscosity of 500 to 50,000 centipoise at 25° C., preferably 1,000 to 35,000, and most preferably 2,000 to 25,000 centipoise. They are typically prepared by ester interchange of aromatic ester and alcohols or glycols by an acidic catalyst. The amount of the aromatic polyester polyol in the polyol component is from 2 to 50 weight percent, preferably from 10 to 35 weight percent, most preferably from 10 to 25 weight percent based upon the polyol component. Examples of aromatic esters used to prepare the aromatic polyesters include phthalic anhydride and polyethylene terephthalate. Examples of alcohols used to prepare the aromatic polyesters are ethylene glycol, diethylene glycol, triethylene glycol, 1,3, propane diol, 1,4 butane diol, dipropylene glycol, tripropylene glycol, tetraethylene glycol, glycerin, and mixtures thereof. Examples of commercial available aromatic polyester polyols are STEPANPOL polyols manufactured by Stepan Company, TERATE polyol manufactured by Hoechst-Celanese, THANOL aromatic polyol manufactured by Eastman Chemical, and TEROL polyols manufactured by Oxide Inc. The weight ratio of glycol to polyether polyol in the polyol component is preferably from 1:1 to 1:1.5, most preferably from 1:1 to 1:1.2. The weight ratio of aromatic polyester to polyether polyol in the polyol component is preferably from 1.5:1.0 to 0.5:1.0, most preferably from 1.1:1.0 to 0.9:1.0.

Although not preferred, minor amounts of phenolic resin and/or amine-based polyols polyol can be added to the polyol component. By minor amounts, it is meant that less than 15 weight percent, preferably less than 5 weight percent, said weight percent based upon the weight of the polyol component. If a phenolic resin is added to the polyether polyol, the preferred phenolic resins used are benzylic ether phenolic resins which are specifically described in U.S. Pat. No. 3,485,797 which is hereby incorporated by reference into this disclosure.

Other optional ingredients which may be added to the polyol component include release agents and adhesion promoters, such as silanes described in U.S. Pat. No. 4,540, 724 which is hereby incorporated into this disclosure by reference, to improve humidity resistance.

Organic polyisocyanates used in the organic polyisocyanate component are liquid polyisocyanates having a functionality of two or more, preferably 2 to 5. They may be aliphatic, cycloaliphatic, aromatic, or a hybrid polyisocyanate. Mixtures of such polyisocyanates may be used. The polyisocyanates should have a viscosity of about 100 to about 1,000, preferably about 200 to about 600.

Representative examples of polyisocyanates which can be used are aliphatic polyisocyanates such as hexamethylene diisocyanate, alicyclic polyisocyanates such as 4,4'-dicyclohexylmethane diisocyanate, and aromatic polyisocyanates such as 2,4- and 2,6-toluene diisocyanate, diphenylmethane diisocyanate, and dimethyl derivates thereof Other examples of suitable polyisocyanates are 1,5-naphthalene diisocyanate, triphenylmethane triisocyanate, xylylene diisocyanate, and the methyl derivates thereof, polymethylenepolyphenyl isocyanates, chlorophenylene-2,4-diisocyanate, and the like.

The polyisocyanates are used in sufficient concentrations to react with the polyether polyol and cure in the presence of the liquid amine curing catalyst. In general the isocyanate ratio of the polyisocyanate to the hydroxyl of the polyol component (NCO/OH ratio), is from 1.25:1.0 to 0.60:1.0, preferably about 0.9:1.0 to 1.1:1.0, and most preferably about 1.0:1:0.

The polyisocyanate component may contain a natural oil such as linseed oil, refined linseed oil, epoxidized linseed oil, alkali refined linseed oil, soybean oil, methyl esters of fatty acids, cottonseed oil, canola oil, refined sunflower oil, tung oil, and dehydrated castor oil. Optional ingredients such as release agents and solvents may also be used in the organic polyisocyanate component.

In this preferred embodiment, the ratio of the isocyanate groups of the polyisocyanate to hydroxyl groups of the polyol is preferably about 0.9:1.0 to about 1.1:1.0, most preferably about 1.0:1:0, the hydroxyl number of the polyol is from about 200 to about 500, and the weight ratio of polyisocyanate to polyether polyol is from about 65:35 to about 35:65, preferably about 45:55. These parameters provide optimum worktime, striptime, and tensile properties.

Although not preferred, solvents may be used in the organic polyisocyanate component and/or polyol component. Most preferably, at least the organic polyisocyanate is solventless. If solvents are used in either component, those skilled in the art will know how to select them. Typical organic solvents which are used include aromatic solvents, esters, or ethers, preferably mixtures of these solvents. Preferably, these solvents are not used in more than 5 weight percent in either the polyol or organic polyisocyanate component.

The liquid amine catalyst is a base having a $pK_b$ value generally in the range of about 7 to about 11. The term "liquid amine" is meant to include amines which are liquid at ambient temperature or those in solid form which are dissolved in appropriate solvents. The $pK_b$ value is the negative logarithm of the dissociation constant of the base and is a well-known measure of the basicity of a basic material. The higher this number is, the weaker the base. The bases falling within this range are generally organic compounds containing one or more nitrogen atoms.

Specific examples of bases which have $pK_b$ values within the necessary range include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine. Preferably used as the liquid tertiary amine catalyst is an aliphatic tertiary amine, particularly [tris (3-dimethylamino) propylamine].

In view of the varying catalytic activity and varying catalytic effect desired, catalyst concentrations will vary widely. In general, the lower the $pK_b$ value is, the shorter will be the worktime of the composition and the faster, more complete will be the cure. In general, catalyst concentrations will be a catalytically effective amount which generally will range from about 0.1% to about 1.25 percent by weight of the Part I, preferably 0.25 percent by weight to 0.625 percent by weight based upon the Part I.

In a preferred embodiment of the invention, the catalyst level is adjusted to provide a worktime for the foundry mix of 1 minutes to 30 minutes, preferably 4 minutes to about 10 minutes, and a striptime of about 1 minutes to 30 minutes, preferably 5 minutes to about 12 minutes. Worktime is defined as the time interval after mixing the polyisocyanate, polyol, and catalyst and the time when the foundry shape reaches a level of 60 on the Green Hardness "B" Scale Gauge sold by Harry W. Dietert Co., Detroit, Mich. Striptime is time interval after mixing the polyisocyanate, polyol, and catalyst and the time when the foundry shape reaches a level of 90 on the Green Hardness "B" Scale Gauge. The aggregate employed with the catalyzed binder in producing the foundry mix should be sufficiently dry so that a handleable foundry shape results after a worktime of 3 to 10 minutes and a strip time of 4 to 12 minutes.

Various types of aggregate and amounts of binder are used to prepare foundry mixes by methods well known in the art. Ordinary shapes, shapes for precision casting, and refractory shapes can be prepared by using the binder systems and proper aggregate. The amount of binder and the type of aggregate used is known to those skilled in the art. The preferred aggregate employed for preparing foundry mixes is sand wherein at least about 70 weight percent, and preferably at least about 85 weight percent, of the sand is silica. Other suitable aggregate materials for ordinary foundry shapes include zircon, olivine, aluminosilicate, chromite sand, and the like.

In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

The binder is preferably made available as a three package system with the polyol component in one package, the organic polyisocyanate component in the second package, and the catalyst in the third package. When making foundry mixes, usually the binder components are combined and then mixed with sand or a similar aggregate to form the foundry mix or the mix can be formed by sequentially mixing the components with the aggregate. Preferably the polyol and catalyst are first mixed with the sand before mixing the isocyanate component with the sand. Methods of distributing the binder on the aggregate particles are well-known to those skilled in the art. The mix can, optionally, contain other ingredients such as iron oxide, ground flax fibers, wood cereals, pitch, refractory flours, and the like.

ABBREVIATIONS

The following abbreviations are used in the examples:

ARPA=aromatic polyester polyol having an OH #=315 based on dimethyl terephthalate and diethylene glycol.

ARPB an aromatic polyester polyol having an OH #=315 based on phthalic anhydride and diethylene glycol.

ARPC=an aromatic polyester polyol having an OH #=530.

BOS=based on sand.

CAT=no-bake catalyst known as comprising tris (3-dimethylamino) propylamine in dipropylene glycol.

PART I=polyether polyol plus a glycol and an aromatic polyester.

PART II=an organic polyisocyanate having a functionality of 2.5 to 2.7.

PEP=a polyether polyol having an OH value of 398, prepared by reacting propylene oxide with trimethylol propane.

POLYOL=polyol comprising 50 weight percent PEP and 50 weight percent TEG.

RH=relative humidity.

ST=striptime (minutes).

TEG=triethylene glycol having an OH # of 748, a functionality of 2, and a viscosity of 35 cps.

VIS=viscosity.

Wedron 540=a silica sand.

WT=worktime (minutes).

EXAMPLES

The sand mixes were prepared by first mixing 4000 parts Wedron 540 sand with the Part I and CAT. Then the Part II was added into the mixture for an additional 2 minutes mixing. The binder level and the amount of catalyst are given in the tables.

Tensile strengths of test dog bone shapes were measured according to the standard tensile strength test. Determining the tensile strengths of the dog bone test shapes enables one to predict how the mixture of sand and binder will work in actual foundry facilities. The dog bones were stored at 0.5 hour, 1.0 hour, 3 hours and 24 hours in a constant temperature room at relative humidity if 50% and a temperature of 25 ° C. before measuring their tensile strengths. Unless otherwise specified, the tensile strengths were also measured in dog-bones stored 24 hours at a relative humidity (RH) of 100%. The results are summarized in Tables I, II, and III. The test conditions were the same in all examples:

Test Conditions

Sand: 4,000 grams Wedron 540

Binder level: 1.25% BOS

Mix ratio: 42 (I)/58 (II)

Catalyst: 4.0%

TABLE I (EFFECT OF ARPA IN BINDER)

| | EXAMPLE NUMBER | | | | |
|---|---|---|---|---|---|
| | Control | 1 | 2 | 3 | 4 |
| BINDER | | | | | |
| PART I (WT %) | | | | | |
| POLYOL | 100.0 | 90.0 | 80.0 | 70.0 | 60.0 |
| ARPA | 0.0 | 10.0 | 20.0 | 30.0 | 40.0 |
| PART II (WT %) | | | | | |
| PIC | 100.0 | 100.0 | 100.0 | 100.0 | 100.0 |
| WT/ST (Min.) | 5.8/10.5 | 5.5/10.2 | 6.0/10.0 | 5.5/10.5 | 4.5/8.75 |
| TENSILE STRENGTHS | | | | | |
| 0.5 hr | 119 | 147 | 151 | 168 | 153 |
| 1.0 hr | 184 | 227 | 231 | 231 | 165 |
| 3.0 hrs | 230 | 259 | 273 | 259 | 197 |
| 24.0 hrs | 240 | 240 | 258 | 284 | 234 |

The results in Table I indicate that the incorporation of ARPA into the POLYOL significantly improved the early tensile strengths of the test cores, i.e. those measured after 0.5, 1 and 3 hours after curing, when compared to the Control without ARPA. The use of the binder with 20% ARPA (Example 2) resulted in tensile strength increases of 27.0, 25.5, and 18.7% at 0.5, 1.0 and 3 hours respectively when compared to the Control. When ARPA level reaches 40% (Example 4), this strength advantage was not apparent. On the other hand, incorporation of ARPA into the binder did not significantly affect the WT/ST. There were only minor differences of the casting quality which resulted from using the ARPA.

Similar experiments were conducted using ARPB as the aromatic polyester in the POLYOL component of the binder. The results were similar and are summarized in Table II.

TABLE II (EFFECT OF ARPB IN BINDER)

| | EXAMPLE NUMBER | | | |
|---|---|---|---|---|
| | Control | 5 | 6 | 7 |
| BINDER | | | | |
| PART I (WT %) | | | | |
| POLYOL | 100.0 | 90.0 | 80.0 | 70.0 |
| ARPB | 0.0 | 10.0 | 20.0 | 30.0 |
| PART II (WT %) | | | | |
| PIC | 100.0 | 100.0 | 100.0 | 100.0 |
| WT/ST (Min.) | 5.5/7.8 | 4.5/7.5 | 4.3/6.8 | 5.0/8.5 |
| TENSILE STRENGTHS | | | | |
| 0.5 hr | 122 | 191 | 202 | 211 |
| 1.0 hr | 175 | 247 | 231 | 276 |
| 3.0 hrs | 187 | 235 | 267 | 248 |
| 24.0 hrs | 211 | 259 | 286 | 277 |

Similar experiments were conducted using ARPC as the aromatic polyester in the POLYOL component of the binder. The results were similar and are summarized in Table III.

TABLE III (EFFECT OF ARPC IN BINDER)

| | EXAMPLE NUMBER | |
|---|---|---|
| | Control | 9 |
| BINDER | | |
| PART I (WT %) | | |
| POLYOL | 100.0 | 90.0 |
| ARPC | 0.0 | 10.0 |
| PART II (WT %) | | |
| PIC | 100.0 | 100.0 |
| WT/ST (Min.) | 5.0/10.0 | 3.5/7.0 |
| TENSILE STRENGTHS | | |
| 0.5 hr | 138 | 228 |
| 1.0 hr | 202 | 238 |
| 3.0 hrs | 230 | 246 |
| 24.0 hrs | 251 | 254 |

ARPC is more reactive then other aromatic polyester polyols (ARPA, and ARPB). Thus, without catalyst level adjustment, it can only be used up to 10%. To incorporate more than 10% of ARPC in the formulation requires a lower amount of catalyst to match the worktime/striptime profile of the control.

What is claimed is:

1. A no-bake foundry binder system comprising as separate components:

(A) a polyol component comprising:
  (1) a polyether polyol;
  (2) a glycol; and
  (3) an aromatic polyester polyol (B) an organic polyisocyanate component; and (C) a catalytically effective amount of a liquid tertiary amine catalyst.

2. The foundry binder system of claim 1 wherein the glycol has a hydroxyl number of 700 to 1200, a viscosity of less than 100 centipoise at 250° C., and is used in amount of 20 weight percent to 40 weight percent, based upon the polyol component.

3. The foundry binder system of claim 2 wherein the polyether polyol has a hydroxyl number of from 300 to 800, a viscosity of 200 to 700 centipoise at 25° C., and is used in amount of 20 weight percent to 40 weight percent, based upon the polyol component.

4. The foundry binder system of claim 3 wherein the aromatic polyester has a hydroxyl number of 700 to 1200, a viscosity of 2,000 to 25,000 centipoise at 25° C., and is used in an amount of from 5 weight percent to 35 weight percent based upon the weight of the polyol component.

5. The foundry binder system of claim 4 wherein the amount of aromatic polyester in the binder is from 10 weight percent to 25 weight percent based upon the weight of the polyol component.

6. The foundry binder system of claim 5 wherein the tertiary amine catalyst is an aliphatic tertiary amine.

7. The foundry binder system of claim 6 wherein the tertiary amine catalyst is tris(3-dimethylamino) propylamine.

* * * * *